United States Patent [19]

Washida

[11] 4,147,457

[45] Apr. 3, 1979

[54] METHOD AND AN APPARATUS FOR DRIVING SHEET PILES INTO THE GROUND

[76] Inventor: Nobuo Washida, No. 354-53 Takenouchi-cho, Takatsuki-shi, Osaka-fu, Japan

[21] Appl. No.: 478,162

[22] Filed: Jun. 10, 1974

[30] Foreign Application Priority Data

Jun. 28, 1973 [JP] Japan ..... 48/73938
Aug. 13, 1973 [JP] Japan ..... 48/91826

[51] Int. Cl.[2] ..... E02B 7/20
[52] U.S. Cl. ..... 405/232; 405/238; 254/29 R
[58] Field of Search ..... 61/53.5, 53.74, 58, 61/59, 60, 63; 254/29 R; 173/1

[56] References Cited

U.S. PATENT DOCUMENTS

| | | | |
|---|---|---|---|
| 3,499,293 | 3/1970 | Kato | 61/53.5 X |
| 3,696,625 | 10/1972 | Alexander | 61/53.5 |
| 3,927,861 | 12/1975 | Dumont | 61/53 X |

*Primary Examiner*—Jacob Shapiro
*Attorney, Agent, or Firm*—Wenderoth, Lind & Ponack

[57] ABSTRACT

A method and apparatus for laying a sheet pile underground. A vertical slit is bored in the ground with an auger as a guide for a sheet pile, and the sheet pile is pushed into the earth in close vicinity to said vertical slit by a jack. The vertical slit is refilled with the removed earth by reverse operation of the auger. The auger for boring the vertical slit is elevatably mounted on the apparatus and an elevator is also mounted on a leader having a sheet pile base and a clamping device thereon for holding the sheet pile thereof between. A retaining frame elevatable under the operation of a jack is also provided on the elevator.

3 Claims, 6 Drawing Figures

METHOD AND AN APPARATUS FOR DRIVING SHEET PILES INTO THE GROUND

The present invention relates to a method for laying sheet piles undergound and an apparatus for bringing said method into enforcement without causing noises and vibrations.

Conventionally, diesel hammers, vibrating machines and the like have been used for the above purpose but they are defective in that they cause noises and vibrations to be annoying for the man.

A first object of this invention is to provide a method for laying sheet piles underground without causing noises and vibrations.

A second object of this invention is to provide an apparatus for putting into force the above-mentioned method.

A third object of this invention is to provide an apparatus as mentioned above capable of changing the direction of said sheet piles as wanted.

These objects can be accomplished by the combination and operation of every part constituting this invention, the preferred embodiments of which will be illustrated in relation with the annexed drawings as following.

Figure 1:
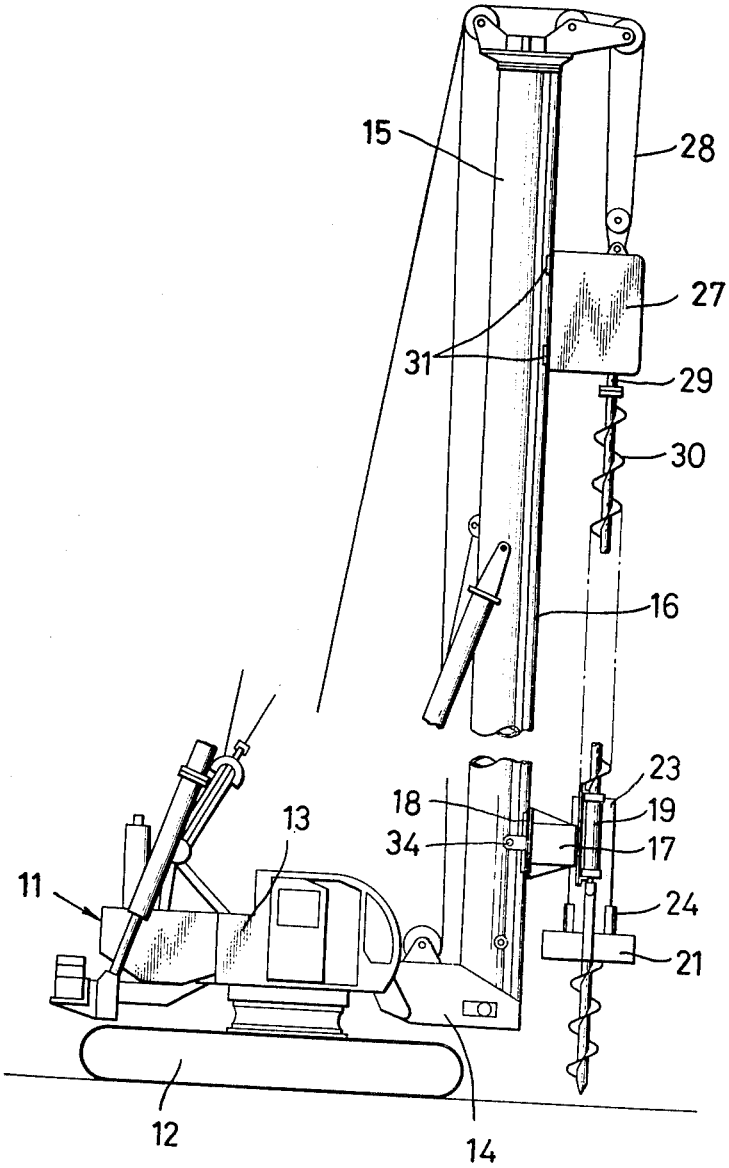
FIG. 1 is a side view of this invention in the first embodiment.
Figure 2:
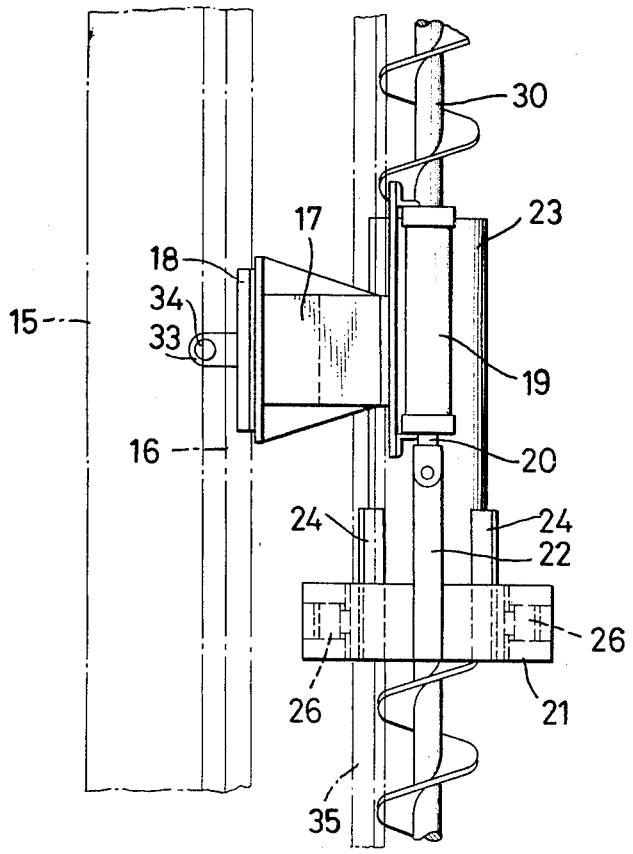
FIG. 2 is a partially-cutaway, magnified side view of the above.
Figure 3:
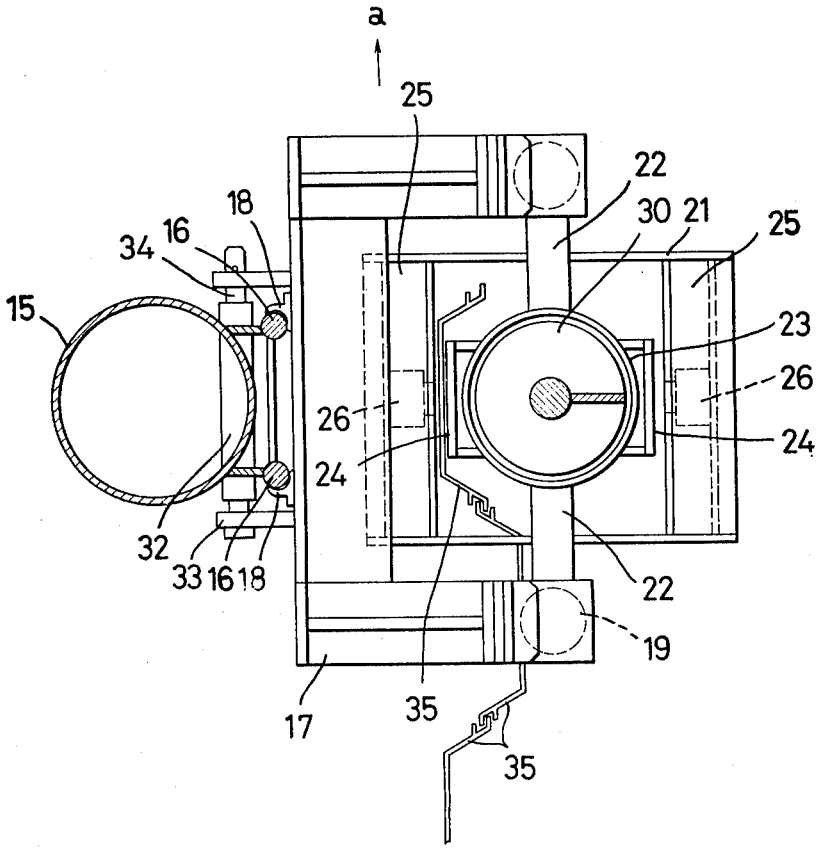
FIG. 3 is a magnified cross-sectional plane of the above.

In the first embodiment shown in FIG. 1 to 3, numeral 11 designates a crane rotatably adapted on a crawler 12, numeral 13 designating the crane proper on the forward portion of which is provided a supporting frame 14 having a cylindrical leader 15 vertically fixed thereon, a pair of guide rails 16 fixing in parallel with each other to said lead 15 at the forward portion thereof, as shown in FIG. 3.

Numeral 17 designates an elevator, a fitting portion 18 at the backside of which movably fits over the foregoing guide rail 16, said elevator 17 being fixed at both sides of forward portion thereof with a pair of jack 19 to be hydraulically operated. Said jack 19 has at the lower terminal thereof a piston rod 20 projecting therefrom, said piston rod 20 at the lower terminal thereof being connected to a pair of vertical connector 22 at the upper terminal thereof, said connectors 22 being unifiedly fixing with a vertical guide tube 23 which extends upward through an interval in between said connectors 22. Said guide tube 23 before and behind the lower outside thereof is adapted with a sheet pile base 24, respectively, said sheet pile base 24 confronting a beam 25 provided in the front and in the rear of said supporting frame 21, said beam 25 being provided with a clamping equipment 26 which confronts said base 24, said clamping equipment 26 being a kind of hydraulic jack playing the role of fixing the sheet pile to the sheet pile base 24 by means of sandwiching said sheet pile in between the sheet pile base 24 and the clamping equipment 26 thereby pressing said sheet pile under the oil-powered pressure of said clamping equipment 26 against said base 24.

Numeral 27 designates a driving device suspended by a rope 28 which hangs down from said leader 15 at the upper terminal thereof, said driving device 27 containing a motor and speed controller therein, said driving device 27 having at the lower portion thereof an outlet spindle 29 projecting therefrom, said outlet spindle 29 connecting to an auger 30 at the upper terminal thereof, said auger 30 movably fitting to said guide tube 23. Said driving device 27 at its fitting portion 31 at the rear side thereof fits over the guide rail 16. The rope 28 is to be operated by a winch provided on said crane proper 13 thereby enabling to lift or descend said driving device 27.

A plural number of horizontal tubes 32 open at both ends thereof being installed at a predetermined interval in front of said leader 15, a retaining pin 34 detachably penetrating into each of said horizontal tubes 32 through a penetration hole of a pair of retainer 33 fixed at the rear side of said elevator 17, said pin 34 being sustained not to slip off by the retainer 33 at the outer terminal thereof.

The crane 11 together with the main body 13 is held horizontally stable with the help of an outrigger and the like, needless to say.

In the first embodiment described hereinbefore, a steel sheet pile 35, as shown in FIG. 3, is inserted in between the beam 24 on the side of the leader 15 and the sheet pile base 24 thereby said steel sheet pile 35 being sufficiently clamped under the force of said clamping equipment 26. After penetrating the retaining pin 34 into the retainer 33 at the penetration hole thereof and the horizontal tube 32 thence fixing the elevator 17 to the leader 15, the driving device 27 is set on to drive the auger 30 downward in a rotary state thereby enabling to bore the vertical slit into the earth, simultaneously the jack 19 starting on operation for pushing down the frame 21 via the piston rod 20 and the connector 22 thereby pressing into the earth the sheet pile 35 which has been clutched in between the base 24 and the clamping equipment 26.

As referring to hereinbefore, the vertical slit helps decrease the necessity of force to apply to the sheet pile for its advance close thereto into the earth, and the vertical slit may well be bored by the auger 30 either before or simultaneously with the work for laying the sheet pile underground.

The upward reaction force inflicted on the jack 19 is communicated to the leader 15 via the retainer 35 provided on the elevator 17, retaining pin 34 and the horizontal tube 32 thereby being absorbed by the crane 11 under the support of its unloaded weight.

In the foregoing process, a stroke of said jack 19 propelling the sheet pile 35 into earth untightens the clamping equipment 26 and releases the sheet pile 35 from said clutch as the result, thereby withdrawing the piston rod 20 of the jack 19 resulting in the ascent of the frame 21 and the connector 22 enabling to clutch again the sheet pile 35 by the clamping equipment 26 and sheet pile base 24 thereby laying the sheet pile underground as described in the above, reiteration of said process leading to the completion of said work as originally purposed. When the sheet pile has been completely laid underground, said auger 30 is reversed directionally thereby working to turn dug earth into the bored vertical slit.

Then, the crane 11 moves by a pitch toward direction as indicated by the arrow mark in FIG. 3 thereby enabling to clutch the steel sheet pile 35 heading in direction opposite to preceding one between the sheet pile base 24 on the opposite side of the leader 15 and the clamping equipment 26 thereby fitting said steel sheet pile 35 at the side edge thereof of the previously in-laid sheet pile 35 for further pushing of said sheet pile 35 into the earth. The leader 15 installed on the crane 11 is preferable to be movable sideways facing the crane 11.

Figure 4:
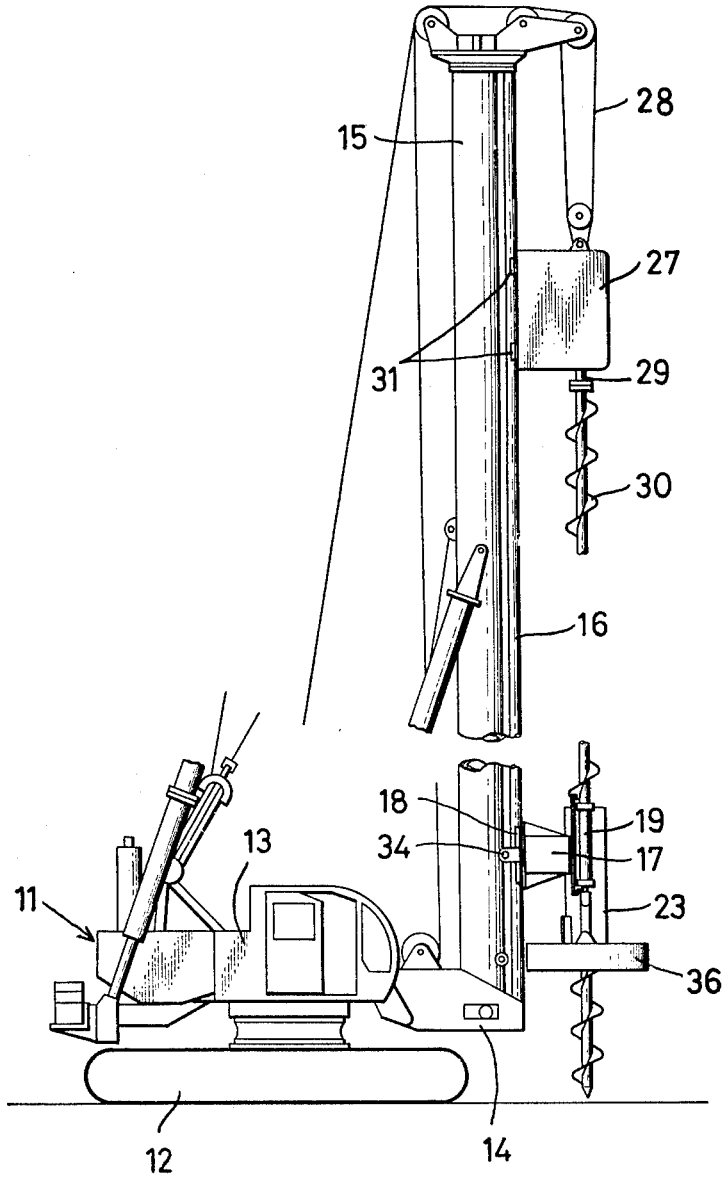
FIG. 4 is a side view of this invention in the 2nd embodiment.
Figure 5:
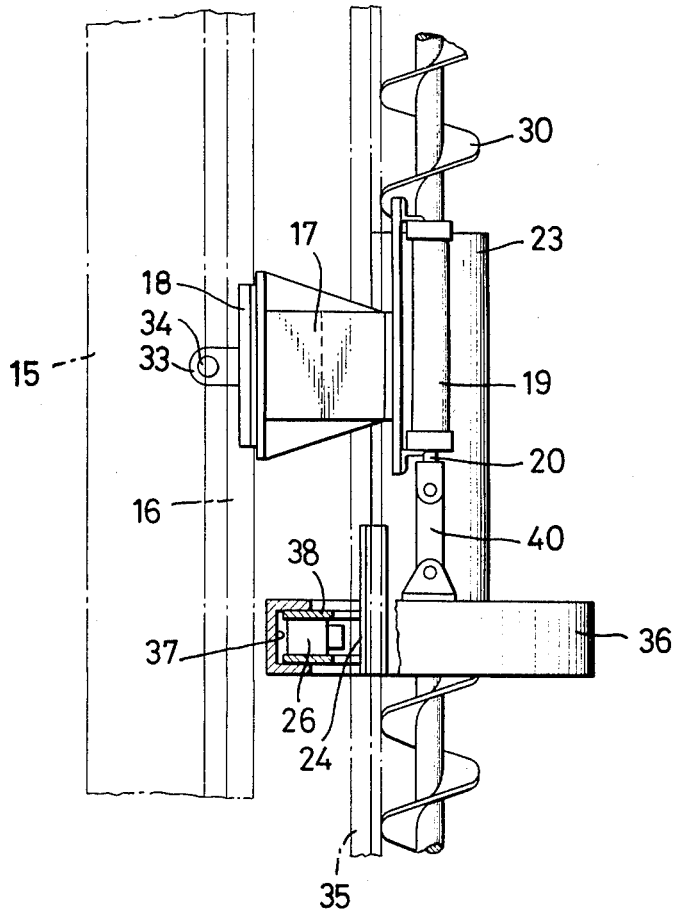
FIG. 5 is a partially-cutaway magnified side view of the above.
Figure 6:
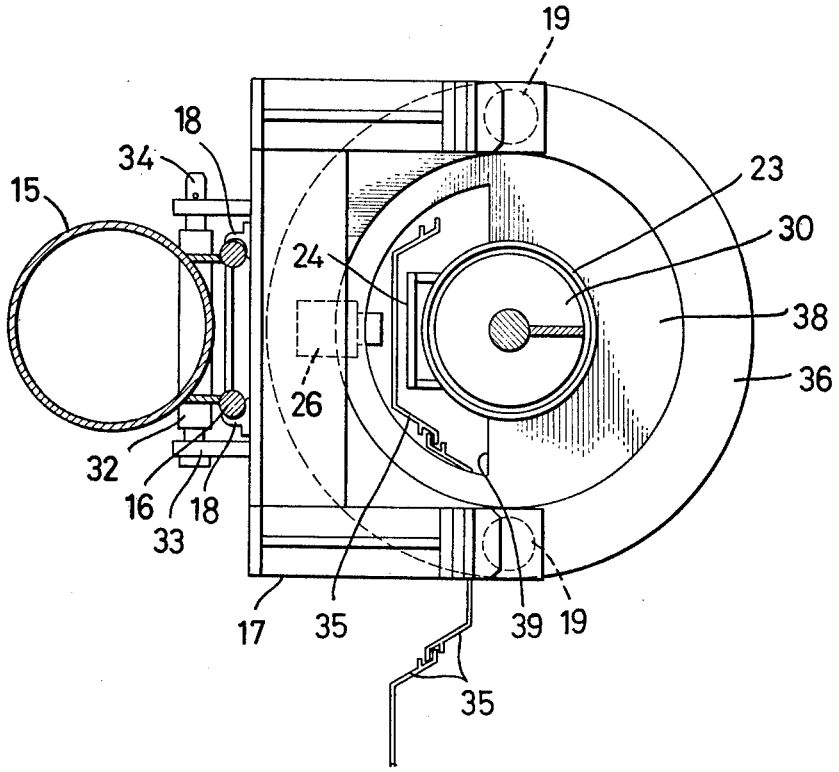
FIG. 6 is a magnified cross-sectional plane of the above.

In the 2nd embodiment illustrated in relation with FIG. 4 to 6 below, those marked with the same numerals as in the preceding embodiment will be exempted from illustration.

Numeral 36 designates a circular frame as a kind of retainer being provided at the inside periphery thereof with a guide groove 37 into which a rotary member 38 at the outer periphery thereof rotatably fits, said rotary member 38 coaxially connecting with the afore-mentioned guide tube 23 wherein at the outer periphery thereof is fixed said sheet pile base 24. Also, said rotary member at a portion abutting on said sheet pile base 24 forms an opening 39 wherein the sheet pile 35 is movably inserted, said rotary member 38 further having at a portion thereof around said opening 39 the afore-mentioned clamping equipment 26 which abuts on said sheet pile base 24. Also, said circular retainer 36 at both sides of the upper portion thereof connects to a connector 40 at the lower terminal thereof, said connector 40 at the upper terminal thereof further connecting with said piston rod 20 at the lower terminal thereof.

In this 2nd embodiment, the sheet pile 35 is laid underground in the same method as in case of the first embodiment after movably inserting the sheet pile 35 in said opening 39 thereby beholding it between said sheet pile 24 and said clamping equipment 26.

This 2nd embodiment is advantageous as compared to the first embodiment in that the sheet pile base 24 and the clamping equipment 26 both for withholding the sheet pile 35 in between them and said guide tube 23 altogether rotate together with said rotary member 38 along said guide groove 37 thereby enabling to change the direction of the sheet pile 35 as wanted while keeping the crane 11 stationary.

This invention using auger and jack as illustrated heretofore enables to carry out the sheet pile underground laying work without causing noises and vibrations as are the case with the conventional method depending on a hammer and a vibrating machine.

To be more advantageous, this invention enables to push the sheet pile down into earth as far as the upward reaction force is sustainable in the apparatus, thereby enabling to carry out the underground sheet pile laying work even in a solid ground. Also, in this invention the vertical slit bored beside the underground said laid sheet pile is refilled firmly with the dug earth by means of the directionally reversed operation of the auger thereby ensuring the construction conducted site against ground fragility which may be the result otherwise.

What is claimed is:

1. An apparatus for driving a sheet pile into the ground comprising:

a vertical support;

jack means fixed to and elevatably adjustable along said vertical support for supplying repeated upward and downward force to drive the pile;

clamping means operatively connected to said jack means for movement with the downward and upward motion of the jack means, for repeatedly clamping therein said sheet pile during the downward motion of the jack means, and for repeatedly releasing said sheet pile means during the upward motion of the jack means, whereby the repeated downward forces exerted on the clamping means by the jack means force the sheet pile clamped by the clamping means into the ground, and whereby release of the sheet pile during the upward movement of the clamping means prevents the sheet pile from being drawn upward and allows the clamping means to clamp the sheet pile at a higher position for the next repeated downward motion of the jack means; and auger means connected to said vertical support above and extending downward through said clamping means for boring a hole into the ground adjacent the position where the pile is being driven simultaneously with the driving of the pile, and for returning the earth removed from the hole back into the hole after the pile is in position in the ground.

2. An apparatus as claimed in claim 1, wherein said jack means is comprised of:

elevator means fitted to and extending outward from said vertical support and vertically adjustable therealong for movement along said vertical support, a pair of separated, downwardly directed, hydraulic jacks connected to said elevator means for movement therewith, and connecting rods attached to the lower ends of said jacks and extending downward therefrom;

said auger means is comprised of:

a drive mechanism above said jack means and movable along said vertical support, and an auger connected to said drive mechanism and extending downward therefrom through said clamping means to the ground, whereby engaging the drive mechanism causes the auger to bore a hole into the ground and whereby reversing the drive mechanism will cause the auger to reverse and return the removed earth back into the hole; and said clamping means is comprised of:

a guide tube between and connected to said connecting rods attached to said hydraulic jacks, and surrounding said auger as it passes through said clamping means, two sheet pile bases attached to said guide tube on the sides not connected to said hydraulic jacks, a supporting frame attached to the lower end of said connecting rods and surrounding said guide tube, two beams within said supporting frame, one opposite each sheet pile base, and two hydraulic clamping pieces, one attached to each beam, directed toward each sheet pile base, whereby a sheet pile between said clamping piece and said sheet pile base is held by the hydraulic force exerted by the clamping piece against the sheet pile base with the sheet pile thereinbetween.

3. An apparatus as claimed in claim 1, wherein said jack means is comprised of:

elevator means fitted to and extending outward from said vertical support and vertically adjustable therealong for movement along said vertical support, a pair of separated, downwardly directed, hydraulic jacks connected to said elevator means for movement therewith, and connecting rods attached to the lower ends of said jacks and extending downward therefrom;

said auger means is comprised of:

a drive mechanism above said jack means and movable along said vertical support, and an auger connected to said drive mechanism and extending downward therefrom through said clamping means to the ground, whereby engaging the drive mechanism causes the auger to bore a hole into the ground and whereby reversing the drive mechanism will cause the auger to reverse and return the removed earth back into the hole; and said clamping means is comprised of:

a circular support frame attached to the lower end of said connecting rods having a guide groove on the inside edge thereof, a rotary member rotatably fitted in the guide groove having first and second openings therethrough, a rotatable guide tube surrounding said auger coaxially fitted through said first opening in said rotary member and rotatable with said rotary member, a sheet pile base positioned beneath the second opening in said rotary member attached to said guide tube, and a clamping piece operatively connected to said rotary member beneath the second opening opposite the sheet pile base and movable with the rotation of said rotary member, whereby the sheet pile to be driven into the ground is inserted through the second hole in said rotary member and clamped between the clamping piece and the sheet pile base by the hydraulic force exerted by the clamping piece against the sheet pile base with the sheet pile thereinbetween, and whereby the sheet pile is positioned by rotating said rotary member and said guide tube, thereby positioning the second opening above the desired location for driving the sheet pile.

* * * * *